United States Patent [19]

Trubiano

[11] 4,090,633

[45] May 23, 1978

[54] COLLAPSIBLE PALLET CONTAINER

[75] Inventor: Antoine Trubiano, Pointe aux Trembles, Canada

[73] Assignee: Cari-All Inc., Montreal, Canada

[21] Appl. No.: 835,864

[22] Filed: Sep. 23, 1977

[51] Int. Cl.[2] ..... B65D 7/24; B65D 7/20; B65D 9/12

[52] U.S. Cl. ..... 220/6; 220/19; 220/1.5; 217/16; 217/43 A; 217/48

[58] Field of Search ..... 220/6, 7, 1.5, 19; 217/48, 43 A, 16

[56] References Cited

U.S. PATENT DOCUMENTS

| | | | |
|---|---|---|---|
| 619,093 | 2/1899 | Shadinger | 217/16 |
| 1,010,841 | 12/1911 | Bailey | 220/6 |
| 1,620,585 | 3/1927 | Walther | 220/6 |
| 3,327,889 | 6/1967 | Dore | 220/19 X |
| 3,348,723 | 10/1967 | Wilson | 220/19 X |

*Primary Examiner*—William Price
*Assistant Examiner*—Steven M. Pollard
*Attorney, Agent, or Firm*—Diller, Brown, Ramik & Wight

[57] ABSTRACT

A collapsible container side wall for use with a material support pallet. The container side wall has a front panel, a rear panel and two side panels, the latter panels being interconnected between opposed end edges of the front and rear panels by a respective hinge connection. Each of the side panels has two panel sections interconnected to each other by a transverse hinge located intermediate the front and rear panels and extending parallel to the hinge connections at the end edges of the front and rear panels. The transverse hinge of one of the two side panels is offset laterally from the transverse hinge of the other side panel whereby the panel sections can fold inwardly with one side panel on top of the other between the front and rear panels with these latter panels collapsing towards each other. Retention means is provided in the lower edge of the container side wall to prevent lateral displacement of the container side wall when positioned about a peripheral area of the pallet.

10 Claims, 8 Drawing Figures

COLLAPSIBLE PALLET CONTAINER

BACKGROUND OF INVENTION (a) Field of the Invention

The present invention relates to an improved collapsible container side wall for use with a material support pallet to form therewith a container for material storage or handling.

(b) Description of Prior Art

Collapsible container side walls for use with material support pallets are known. However, the side walls consist of four panels hinged at their ends together whereby these may fold with two panels in side-by-side position one on top of the other. Therefore the length of the folded side wall is equal to the length of two panels which is greater than the size of the pallet. A problem with such collapsible side walls is that because of the size of the side walls, when collapsed, these are bulky to store and difficult to ship. Also, a further disadvantage of known container side walls, is that these are not always stable when positioned about a pallet and cannot be used in a stacking arrangement one on top of the other as there is no means to support a further pallet on top of the side wall. Furthermore, many of the known side wall constructions are weak and cannot support any top loads. Still further, because of the manner in which the side walls collapse they are not stackable on top of the pallet in a convenient manner to secure them, in their collapsed position, on top of the pallet for shipping and normally the pallets and the container side walls are separated when these are returned for refill.

SUMMARY OF INVENTION

It is a feature of the present invention to provide an improved collapsible container side wall which substantially overcomes all of the above-mentioned disadvantages.

A further feature of the present invention is to provide a container side wall which is collapsible in a small package to fit within the surface area of a support pallet.

A still further feature of the present invention is to provide a container side wall having collapsible side panels and further having means to secure the side wall onto a support pallet.

According to the above features, from a broad aspect, the present invention provides a collapsible container side wall for use with a material support pallet. The container side wall has a front panel, a rear panel and two side panels, the latter panels being interconnected between opposed end edges of the front and rear panels by a respective hinge connection. Each of the side panels has two panel sections interconnected to each other by a transverse hinge located intermediate the front and rear panels and extending parallel to the hinge connections at the end edges of the front and rear panels. The transverse hinge of one of the two side panels is offset laterally from the transverse hinge of the other side panel whereby the panel sections can fold inwardly with one side panel on top of the other between the front and rear panels with these latter panels collapsing towards each other. Retention means is provided in the lower edge of the container side wall to prevent lateral displacement of the container side wall when positioned about a peripheral area of the pallet.

BRIEF DESCRIPTION OF DRAWINGS

A preferred embodiment of the present invention will now be described with reference to the accompanying drawings in which.

DESCRIPTION OF PREFERRED EMBODIMENTS

Figures 1, 2, 3, 4, 5, 6, 7, 8:
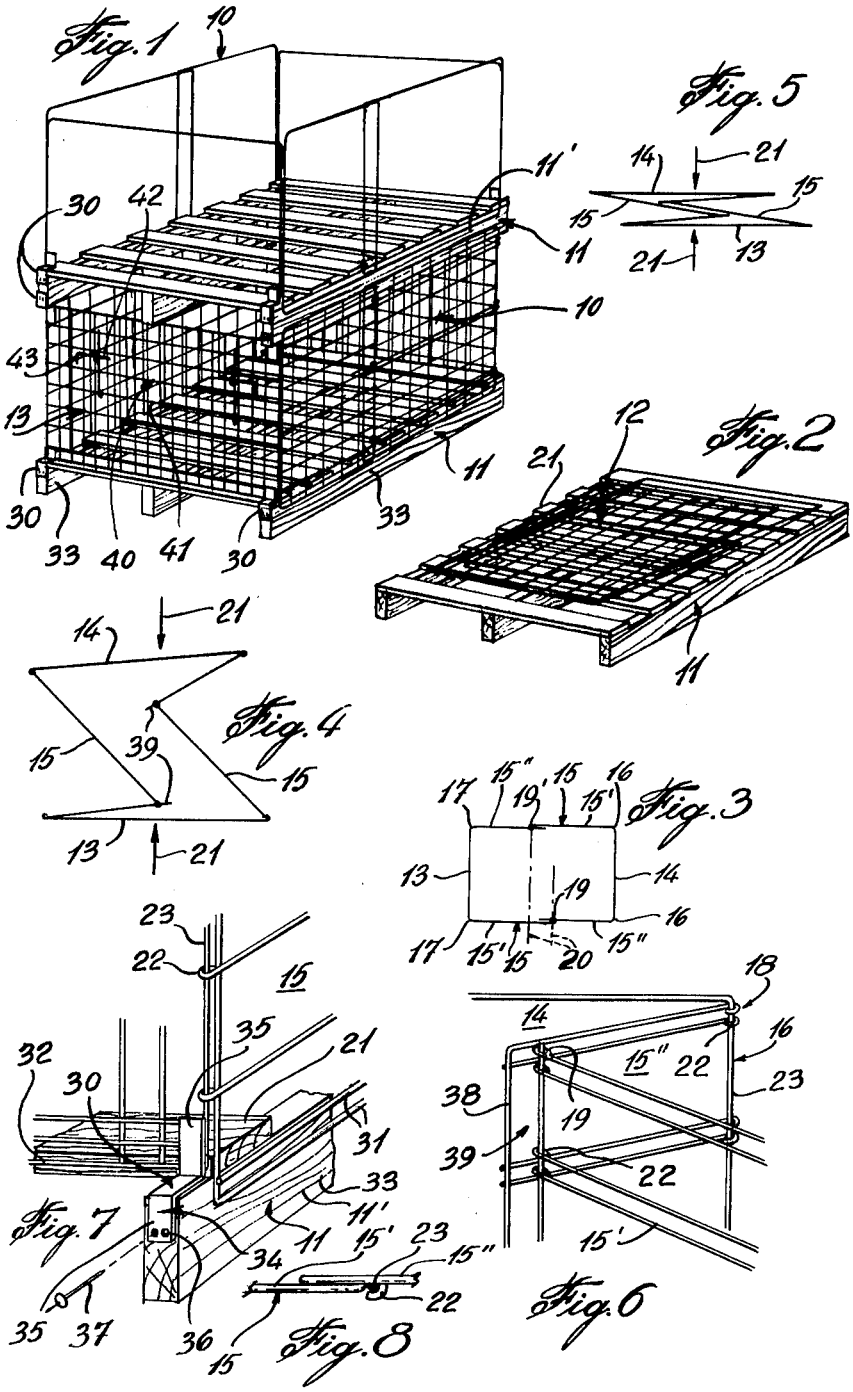
FIG. 1 is a perspective view illustrating the collapsible container side wall in use with one or more material support pallets.
FIG. 2 is a perspective view illustrating the collapsible container side wall in its collapsed position stored on a pallet.
FIG. 3 is a schematic top view illustrating the disposition of the transverse hinges in the side panels.
FIG. 4 is a schematic view illustrating a sequence of folding the panels of the container side wall.
FIG. 5 is a further schematic view illustrating a further sequence of the folding of the panels of the side wall.
FIG. 6 is a fragmented perspective view illustrating the transverse hinge connection and abutment wall of the panel sections of the side panel.
FIG. 7 is a fragmented perspective view illustrating the retention means to prevent displacement of the side wall when positioned about the peripheral area of the pallet.
FIG. 8 is a fragmented top view illustrating the transverse hinge connection with the panel sections of a side panel in its open position.

Referring now to the drawings and more particularly to FIGS. 1, 3, 6 and 7, there is shown generally at 10 the collapsible container side wall of the present invention. The side wall 10, when in use, is positioned about a peripheral area of a pallet 11 whereby to constitute a container for the transport or storage of material therein. The side wall 10 is collapsible to form a callapsed side wall package 12 (see FIG. 2) having a surface area which is not greater than the surface area of the pallet 11. This permits the collapsed package to be strapped onto the pallet 11 whereby not to take excess space on a floor after the use of the container. Also this facilitates shipping of the side wall and pallet when not in use.

The container side wall 10 has a front panel 13, a rear panel 14, and two side panels 15. The side panels 15 are each interconnected between opposed end edges 16 and 17, of the rear and front panels 14 and 13 respectively, by a respective hinge connection 18 (see FIG. 6).

Each of the side panels 15 has two panel sections 15' and 15'' which are interconnected to each other by a transverse hinge 19 located intermediate the front and rear panels 13 and 14 and extending parallel to the end edges 16 and 17 of the rear and front panels.

As shown in FIG. 3, the transverse hinge 19 of one of the two side panels 15 is offset laterally from the transverse hinge of the other panel 15 as illustrated by the transverse axes 20 passing through each hinge connection 19. This permits the panel sections to be folded inwardly with one side panel on top of the other between the front and rear panels as shown in FIGS. 4 and 5. By offsetting the hinges 19, it can be shown that one of the side panels 15 will collapse under the other side panel 15. The collapsing takes place in the direction of the arrows 21 as shown in FIGS. 4 and 5 until all the panels rest on top of one another.

Referring now to FIG. 7, there is shown the provision of retention means in the lower edge of the container side wall 10 to prevent lateral displacement of the container side wall when positioned about a peripheral area of the pallet 11. The retention means is provided by a bracket 30 which is secured to at least diagonally opposite corners of the container side wall and in this particular embodiment a bracket 30 is secured to each bottom corner of the front and rear panels 13 and 14. The retention means is further provided by the side panels having at least a portion of a bottom edge thereof provided with an extension 31 whereby when the side wall is positioned about a pallet, the extension will protrude beyond the bottom edge 32 of the front and rear panels and be disposed over a portion of the respective side 33 of the pallet 11.

The bracket 30 is provided with a retention arm 34 and a secured arm 35, the latter being fastened to the bottom corners of the front and rear panels. The retention arm 34 extends beyond the bottom edge 32 of the front and rear panels and is constituted by a flat L-shaped section extending horizontally outwards from the bottom edge 32 of the front and rear panels, and then transversely downward to define a spaced securable end section 34'. This end section 34' is provided with one or more holes 36 to permit passage of a fastener, herein a nail 37, therethrough to engage the bracket 30 to the pallet. As shown in FIG. 7 the bracket 30 is secured to a support leg 11' of the pallet 11.

As shown in FIG. 1, brackets 30 are also secured to the top corners of the front and rear panels 13 and 14 whereby a further pallet 11 may be supported on top of the side wall 10. A further side wall 10 can also be positioned on top of the further pallet 11 and the stacking can continue upwards to a recommended height. The brackets 30 positioned in the top corners of the front and rear panels have their securable end sections 34' protruding upwardly above the top edge of these panels and can be secured by fasteners in the support legs 11' of the top pallet.

Referring now to FIGS. 6 and 8 it can be seen that the transverse hinge 19 is located inwardly spaced from a free vertical edge 38 of one of the two panel sections, herein panel section 15", whereby to define an abutment wall in that portion of the panel section 15" between the transverse hinge connection 19 and the free edge 38 to restrain the two panel sections 15' and 15" against outward displacement (see FIG. 8) when the side wall 15 is positioned about the pallet 11 as shown in FIG. 1.

Referring again to FIG. 1 there is shown a gate 40 provided in the front panel 13. The gate 40 extends inwardly of the edges of the panel 13 whereby the corners of the front panel have structural wire members to provide rigid vertical supports in the corner area of the side wall. The gate 40 is provided in the top portion of the front panel 13 and hinged at a lower edge 41 thereto. The gate 40 is securable within the front panel 13 by means of locking rods 42 displaceable and lockable axially by means of a U-shaped clamp 43 which engages between vertical wire members in the gate 40.

The complete side wall 10 is constructed of rigid metal wires welded together. The brackets 30 are steel plates also welded in the corners of the front and rear panels.

As shown in FIG. 7 when the side wall is positioned about the peripheral area of a pallet 11 it is held in rigid engagement therein by the brackets 30 and the extension 31 in the bottom edge portion of the side panels 15. In order to disengage the side wall from the pallet it is necessary to lift the panel from either the front or rear by disengaging the front or rear panels whereby to displace the extensions 31 above the top surface 21 of the pallet. The side wall sections 15' and 15" can then be collapsed inwardly in the manner as shown in FIGS. 4 and 5 with the front and rear panels folded toward each other. In the particular embodiment disclosed the panel sections 15' and 15" are of different lengths and substantially equal to a corresponding section of the opposed side panel. Also all the hinge connections are constituted by looping wire ends such as shown at 22 in FIGS. 6 and 7 about transverse wires such as 23.

It is within the ambit of the present invention to provide any obvious modifications of the preferred embodiment disclosed herein provided such modifications fall within the scope of the claims appended hereto.

I claim:

1. A collapsible container side wall for use with a material support pallet; said container side wall having a front panel, a rear panel and two side panels interconnected between opposed end edges of said front and rear panels by a respective hinge connection; each said side panels having two panel sections interconnected to each other by a transverse hinge located intermediate said front and rear panels and extending parallel to said end edges, said transverse hinge of one of said two side panels being offset laterally from the transverse hinge of the other side panel whereby said panel sections can fold inwardly with one side panel on top of the other between said front and rear panels with these latter panels collapsing towards each other, and retention means in a lower edge of said container side wall to prevent lateral displacement of said container side wall when positioned about a peripheral area of said pallet.

2. A collapsible container side wall as claimed in claim 1 wherein said retention means is a bracket secured in at least diagonally opposite lower corners of said container side wall when positioned over said pallet with all said panels being at substantially right angles to each other.

3. A collapsible container side wall as claimed in claim 2 wherein said side panels have at least a portion of a bottom edge thereof provided with an extention protruding beyond a bottom edge of said front and rear panels, said extension being disposed over a portion of a respective side of said pallet.

4. A collapsible container as claimed in claim 2 wherein said bracket is secured to each bottom corner of said front and rear panels, said bracket having a retention arm extending beyond a bottom edge of said front and rear panels, and means to secure said retention arm to said pallet.

5. A collapsible container as claimed in claim 4 wherein further ones of said bracket are secured to top corners of said front and rear panels to support a further pallet on top of said side wall.

6. A collapsible container as claimed in claim 4 wherein said means to secure said retention arm to said pallet is constituted by one or more holes in said retention arm to permit passage of a fastener therethrough to engage said retention arm to said pallet.

7. A collapsible container as claimed in claim 6 wherein said retention arm is a flat L-shaped plate extending horizontally outwards from said bottom edge of said front and rear panels and then transversely downward to define a spaced securable end section.

8. A collapsible container as claimed in claim 1 wherein said transverse hinge is located inwardly spaced from a free vertical edge of one of said two panel sections to define an abutment wall in that portion of said panel section between said transverse hinge and said free end to restrain said two panel sections against outward displacement when said side wall is positioned about said pallet.

9. A collapsible container side wall as claimed in claim 1 wherein all said panels are collapsible on top of each other to form a collapsed side wall package, said package having a surface area which is not greater than the surface area of said pallet.

10. A collapsible container side wall as claimed in claim 9 wherein said panels are constructed from solid metal wire secured together, said hinge connections and transverse hinges being formed by looping wire end sections about transverse wires.

* * * * *